US006790600B2

(12) United States Patent
Schwartz et al.

(10) Patent No.: US 6,790,600 B2
(45) Date of Patent: Sep. 14, 2004

(54) METHOD OF COLOR PHOTOGRAPHIC PROCESSING FOR COLOR PHOTOGRAPHIC PAPERS

(75) Inventors: Paul A. Schwartz, Webster, NY (US); Valerie L. Kuykendall, Penfield, NY (US); Eric R. Schmittou, Rochester, NY (US); Leif P. Olson, Rochester, NY (US); Susan M. Flavin, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/361,173

(22) Filed: Feb. 7, 2003

(65) Prior Publication Data

US 2004/0157172 A1 Aug. 12, 2004

(51) Int. Cl.[7] ..... G03C 7/407
(52) U.S. Cl. ..... 430/393; 430/430
(58) Field of Search ..... 430/393, 430

(56) References Cited

U.S. PATENT DOCUMENTS

| | | | | |
|---|---|---|---|---|
| 2,432,864 A | | 12/1947 | Dimsdale et al. | |
| 4,912,026 A | | 3/1990 | Miyoshi et al. | 430/546 |
| 4,933,264 A | | 6/1990 | Haseler et al. | 430/372 |
| 5,021,326 A | | 6/1991 | Meckl et al. | 430/399 |
| 5,401,621 A | * | 3/1995 | Kojima et al. | 430/393 |
| 5,491,052 A | | 2/1996 | VanMeter et al. | 430/545 |
| 5,543,281 A | | 8/1996 | Isaac et al. | 430/551 |
| 5,773,202 A | | 6/1998 | Haye et al. | 430/393 |
| 5,814,437 A | * | 9/1998 | Nakahanada et al. | 430/393 |
| 5,976,772 A | | 11/1999 | Hubsch et al. | 430/393 |
| 6,001,545 A | | 12/1999 | Foster et al. | 430/455 |
| 6,245,496 B1 | | 6/2001 | Yokozawa | 430/543 |
| 6,291,151 B1 | | 9/2001 | Yoneyama et al. | 430/547 |
| 6,534,253 B1 | * | 3/2003 | Kuykendall et al. | 430/393 |
| 6,670,108 B1 | * | 12/2003 | Schmittou | 430/393 |

FOREIGN PATENT DOCUMENTS

| | | |
|---|---|---|
| DE | 100 13 614 A1 | 10/2001 |
| JP | 9-160197 | 6/1997 |
| JP | 2000-310839 | 11/2000 |

* cited by examiner

*Primary Examiner*—Hoa Van Le
(74) *Attorney, Agent, or Firm*—J. Lanny Tucker

(57) ABSTRACT

A method of processing photographic color papers is carried out using a photographic bleach-fixing composition in a bleach-fixing step that is carried out for less than 60 seconds. The bleach-fixing composition comprises certain aliphatic or aromatic sulfur-containing compounds that include a —N═C(SH)—group. The bleach-fixing composition can be prepared from a two-part bleach-fixing kit having two solutions that can be added directly to a processing chamber or premixed to form a replenisher solution.

19 Claims, No Drawings

METHOD OF COLOR PHOTOGRAPHIC PROCESSING FOR COLOR PHOTOGRAPHIC PAPERS

FIELD OF THE INVENTION

This invention relates in general to photography. More particularly, it relates to a method for rapidly processing photographic color papers using a bleach-fixing composition provided from two individual solutions or parts. It also relates to a photographic kit containing these solutions.

BACKGROUND OF THE INVENTION

The basic image-forming process of color silver halide photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material.

To obtain useful color images, it is usually necessary to remove all of the silver from the photographic element after color development. This is sometimes known as "desilvering". Removal of silver is generally accomplished by oxidizing the metallic silver in what is known as a "bleaching" step using a bleaching agent, and then dissolving the oxidized silver and undeveloped silver halide with a silver "solvent" or fixing agent in what is known as a "fixing" step.

It has become common for the processing of certain photographic elements, notably color photographic papers, to combine the bleaching and fixing operations into a single "bleach-fixing" operation that can be carried out in one or more processing steps. Bleach-fixing is usually carried out using a composition that includes both a photographic bleaching agent and a photographic fixing agent, as described for example in U.S. Pat. No. 4,033,771 (Borton et al.).

The most common bleaching agents for color photographic processing are complexes of ferric [Fe(III)] ion and various organic chelating ligands (such as aminopolycarboxylic acids), of which there are hundreds of possibilities, all with varying photographic bleaching abilities and biodegradability. Common organic chelating ligands used as part of bleaching agents for photographic color film processing include ethylenediaminetetraacetic acid (EDTA), 1,3-propylenediaminetetraacetic acid (PDTA) and nitrilotriacetic acid (NTA). Common color paper bleaching is often carried out using EDTA as a chelating ligand. Also known are bleaching, bleach-fixing compositions, and processing methods that utilize a ferric complex of one or more of several alkyliminodiacetic acids (such as methyliminodiacetic acid or MIDA) that are known to be more biodegradable than other common organic chelating ligands such as EDTA. Other photographic bleaching agents using similar organic chelating ligands are described in U.S. Pat. No. 5,061,608 (Foster et al.).

Typical photographic fixing agents include thiosulfates, sulfites, thiocyanates, and mixtures thereof that readily solubilize or "dissolve" silver ion in the processed photographic materials, as described for example in U.S. Pat. No. 5,633,124 (Schmittou et al.).

As pointed out in U.S. Pat. 5,055,382 (Long et al.), when photographic materials are processed in bleach-fixing steps, the bleach-fixing composition is generally formulated from two or more "parts", each "part" or solution typically containing one or more (but not all) of the photochemicals necessary for the processing reactions. For example, one of the "parts" usually contains the conventional ferric bleaching agent, and another of the "parts" usually contains a thiosulfate fixing agent(s) and a sulfite preservative. These "parts" are sometimes provided together in a photochemical processing "kit". If all of the chemicals are formulated in a single concentrate solution, storage stability is reduced or nonexistent since unwanted chemical interactions among components are inevitable. For example, ferric bleaching agents, sulfite preservatives, and thiosulfate fixing agents are inherently reactive, thereby degrading solution effectiveness and storage stability. Thus, most common bleach-fixing solutions are provided from "two parts", each part containing at least one essential reactive component.

While most commercial bleach-fixing compositions satisfactorily remove silver from the processed photographic materials, sometimes a given set of processing conditions, processing compositions, and processed materials results in insufficient silver removal, especially in photographic color papers. This problem may be accentuated during "rapid" processing of the photographic color papers, for example, where the bleach-fixing time is less than 35 seconds. Moreover, the problem is more prominent when certain photographic color papers are rapidly processed, for example when color papers containing silver iodide, phenyl meccaptotetrazole, or block copolymers in the photographic emulsions are rapidly processed.

There is a need in the industry for the ability to rapidly process a variety of photographic color papers using bleach-fixing compositions that contain generally known components and that can be readily used under a variety of replenishing conditions.

SUMMARY OF THE INVENTION

This invention provides a method of providing a color photographic image comprising contacting a color developed photographic color paper in a processing chamber with a photographic bleach-fixing composition that has a pH of from about 3.5 to about 8 and comprises:

- at least 0.02 mol/l of a ferric-ligand photographic bleaching agent,
- at least 0.1 mol/l of a photographic fixing agent, and
- at least 0.01 mmol/l of a sulfur-containing compound represented by the one or more of the following Structures I, II, III, IVa, IVb, and V:

(I)

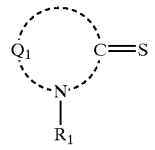

wherein $Q_1$ represents a group of atoms that are necessary to complete a nitrogen-containing heterocyclic ring, and $R_1$ represents hydrogen, or an alkyl, cycloalkyl, aryl, heterocyclic, or amino group, (II)

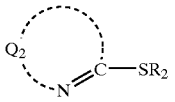

wherein $Q_2$ represents a group of atoms that are necessary to complete a nitrogen-containing heterocyclic ring, and $R_2$ represents hydrogen, an alkali metal atom, a

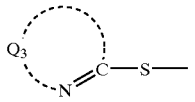

group wherein $Q_3$ is defined the same as $Q_2$, or an alkyl group, (III)

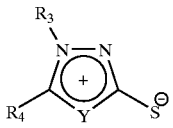

wherein $R_3$ and $R_4$ are independently alkyl, cycloalkyl, alkenyl, alkynyl, aralkyl, aryl, or heterocyclic groups, or $R_4$ can be hydrogen, and Y is —O—, —S—, or —N($R_5$)— wherein $R_5$ is an alkyl, cycloalkyl, alkenyl, alkynyl, aryl, heterocyclic, amino, acylamino, sulfonamido, ureido, or sulfamoylamino group, or $R_3$ and $R_4$, or $R_4$ and $R_5$, taken together, independently, may form a heterocyclic ring, (IVa)

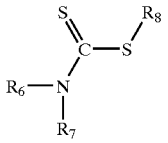

(IVb)

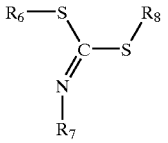

wherein $R_6$, $R_7$, and $R_8$ independently represent hydrogen, alkali metal ions, or alkyl, cycloalkyl, alkenyl, alkynyl, aralkyl, aryl, heterocyclic, amino, acylamino, ureido, or sulfamoylamino groups, and (V)

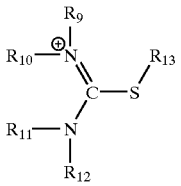

wherein $R_9$, $R_{10}$, $R_{11}$ and $R_{12}$ independently represent hydrogen, alkali metal ions, or alkyl, cycloalkyl, alkenyl, alkynyl, aralkyl, aryl, heterocyclic, amino, acylamino, ureido, or sulfamoylamino groups, and $R_{13}$ represents an alkyl, cycloalkyl, alkenyl, alkynyl, aralkyl, aryl, heterocyclic, amino, acylamino, ureido, or sulfamoylamino group, the bleach-fixing composition provided by delivery to the processing chamber of a bleach-fixing replenisher at a rate of at least 5.4 ml/$m^2$, the bleach-fixing replenisher being provided by mixing individual Solutions A and B, wherein Solution A comprises at least 0.5 mol/l of the photographic fixing agent, and Solution B comprises at least 0.1 mol/l of the ferric-ligand photographic bleaching agent, and either or both of Solutions A and B comprise at least 0.05 mmol/l of the sulfur-containing compound, Solution A being mixed with Solution B at a volume ratio of from about 4:1 to about 0.5:1, and the contacting being carried out for less than 60 seconds.

This invention also provides a method of providing a color photographic image comprising contacting a color developed photographic color paper in a processing chamber with a photographic bleach-fixing composition that has a pH of from about 3.5 to about 8 and comprises:

at least 0.02 mol/l of a ferric-ligand photographic bleaching agent, at least 0.1 mol/l of a photographic fixing agent, and at least 0.01 mmol/l of a sulfur-containing compound represented by one or more of the Structures I, II, III, IVa, IVb, and V defined above, the bleach-fixing composition provided by delivery to the processing chamber of Solutions A and B, wherein Solution A comprises at least 0.5 mol/l of the photographic fixing agent, and Solution B comprises at least 0.1 mol/l of the ferric-ligand photographic bleaching agent, and either or both of Solutions A and B comprise at least 0.05 mmol/l of the sulfur-containing compound defined above, Solutions A and B being delivered to the processing chamber at a volume ratio of from about 4:1 to about 0.5:1 (A:B), and the contacting being carried out for less than 60 seconds.

This invention also provides a method for providing a color photographic image comprising:

A) color developing an imagewise exposed photographic color paper using a color developing composition, and B) bleach/fixing the photographic color paper in a processing chamber with a photographic bleach-fixing composition having a pH of from about 3.5 to about 8 and that comprises:

at least 0.02 mol/l of a ferric-ligand photographic bleaching agent, at least 0.1 mol/l of a photographic fixing agent, and at least 0.01 mmol/l of a sulfur-containing compound represented by one or more of the Structures I, II, III, IVa, IVb, and V defined above, the bleach-fixing composition provided by delivery to the processing chamber of a bleach-fixing replenisher at a rate of at least 5.4 ml/$m^2$, the bleach-fixing replenisher being provided by mixing two individual Solutions A and B, wherein Solution A comprises at least 0.5 mol/l of the photographic fixing agent, and Solution B comprises at least 0.1 mol/l of the ferric-ligand photographic bleaching agent, and either or both of Solutions A and B comprise at least 0.05 mmol/l of the sulfur-containing compound, Solution A being mixed with Solution B at a volume ratio of from about 4:1 to about 0.5:1 (A:B), and optionally the bleach-fixing replenisher being mixed with water relative to Solution A at a volume ratio up to 1:20 (A:water), and the bleach-fixing being carried out for less than 60 seconds.

In preferred embodiments, this invention provides a method for providing a color photographic image comprising:

A) color developing an imagewise exposed photographic color paper using a color developing composition, the photographic color paper comprising a silver halide emulsion comprising at least 0.3 mol % silver iodide based on total silver halide in the emulsion, a polyalkylene oxide compound, or a mercaptotetrazole, B) bleach-fixing the color developed photographic color paper in a processing chamber with a photographic bleach-fixing composition having a pH of from about 5.5 to about 7.5 and that comprises:

from about 0.05 to about 0.3 mol/l of an iron complex of ethylenediaminetetraacetic acid, ethylenediaminedisuccinic acid, or 1,3-propylenediaminetetraacetic acid as a ferric-ligand photographic bleaching agent, from about 0.2 to about 2 mol/l of thiosulfate photographic fixing agent, and from about 0.04 to about 1 mmol/l of one or more of the following compounds (I) through (XIV):

(I)

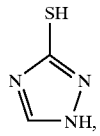

(II)

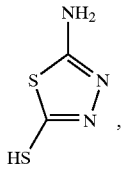

(III)

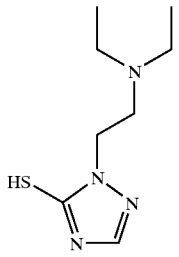

(IV)

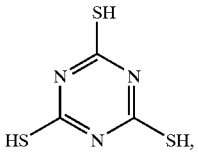

(V)

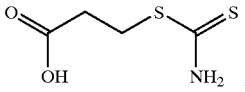

(VI)

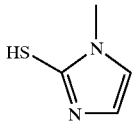

(VII)

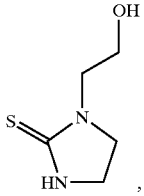

-continued (VIII)

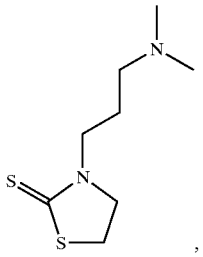

(IX)

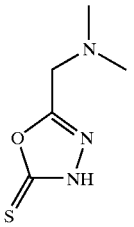

(X)

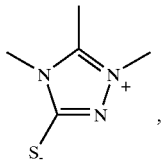

(XI)

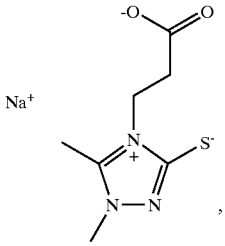

(XII)

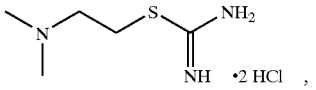

(XIII)

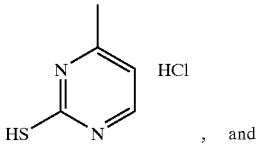

(XIV)

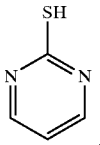

the photographic bleach-fixing composition provided by delivery of a bleach-fixing replenisher to the processing chamber at a rate of at least 5.4 ml/$m_2$, wherein the photographic bleach-fixing replenisher comprises from about 0.05 to about 1.2 mol/l of an iron complex of ethylenediaminetetraacetic acid, ethylenediaminedisuccinic acid, or 1,3-propylenediaminetetraacetic acid as a ferric-ligand photographic bleaching agent, from about 0.2 to about 4 mol/l of thiosulfate photographic fixing agent, and from about 0.04 to about 4 mmol/l of one or more of the compounds (I) through (XIV):

the photographic bleach-fixing replenisher being provided by mixing individual Solutions A and B, wherein Solution A comprises from about 1 to about 5 mol/l of the thiosulfate photographic fixing agent, and Solution B comprises from about 0.05 to about 2 mol/l of the ferric-ligand photographic bleaching agent, and either or both of Solutions A and B comprise from about 0.2 to about 5 mmol/l of the one or more of Compounds (I) through (XIV) defined above, Solution A being mixed with Solution B at a volume ratio of from about 1:1 to about 3:1 (A:B), and optionally mixed with water at a volume ratio relative to Solution A of up to 1:10, and the bleach-fixing being carried out for from about 18 to about 35 seconds, and C) contacting the photographic color paper with a stabilizing or rinsing solution.

This invention further provides a photographic processing kit of this invention comprising:

a) Solution A comprising at least 0.5 mol/l of a photographic fixing agent, and b) Solution B comprising at least 0.05 mmol/l of a ferric-ligand photographic bleaching agent, and either or both of Solutions A and B comprising at least 0.05 mmol/l of a sulfur-containing compound represented by one or more of the Structures I, II, III, IVa, IVb, and V defined above.

The method of this invention provides a means for rapid silver removal and such rapid photographic processing of a variety of photographic color papers, and especially those color papers that have certain features such as a silver halide emulsion containing at least 0.3 mol % of silver iodide (based on total silver halide), a polyalkylene oxide compound, or a mercaptotetrazole.

These advantages are achieved by using a sulfur-containing compound represented by Structures I, II, III, IVa, IVb, or V in the bleach-fixing composition. This compound can be supplied in one or both solutions of a two-part processing kit that includes all of the necessary chemicals for bleach-fixing.

DETAILED DESCRIPTION OF THE INVENTION

Photographic bleach-fixing is carried out in the practice of this invention using one or more bleach-fixing steps. At least one of those steps is carried out using the photographic bleach-fixing composition described herein A first essential component of these bleach-fixing compositions includes one or more photographic bleaching agents that are Fe(III)-ligand complexes wherein the ligand is usually a polycarboxylic acid. Preferred polycarboxylic acid ligands include aminopolycarboxylic acid and polyaminopolycarboxylic acid chelating ligands.

Particularly useful chelating ligands include conventional polyaminopolycarboxylic acids including ethylenediaminetetraacetic acid and others described in *Research Disclosure*, publication 38957, pages 592–639 (September 1996), U.S. Pat. No. 5,334,491 (Foster et al.), U.S. Pat. No. 5,582,958 (Buchanan et al.), and U.S. Pat. No. 5,753,423 (Buongiorne et al.). *Research Disclosure* is a publication of Kenneth Mason Publications Ltd., Dudley House, 12 North Street, Emsworth, Hampshire P010 7DQ England. This reference will be referred to hereinafter as "Research Disclosure." There are hundreds of possible chelating ligands that are known in the art, the most common ones being ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA), N-(2-carboxyphenyl)ethylenediamine-N,N',N"-triacetic acid, and hydroxyethyl-ethylenediaminetriacetic acid (HEDTA). The most preferred ligands include EDTA, EDDS (defined below), MIDA (defined below), and PDTA.

Biodegradable chelating ligands are also useful in order to minimize the impact on the environment from discharged photoprocessing solutions.

One particularly useful biodegradable chelating ligand is ethylenediaminedisuccinic acid (EDDS) and other similar compounds that are described in U.S. Pat. No. 5,679,501 (Seki et al.) and EP 0 532 001B1 (Kuse et al.). All isomers of EDDS are useful and the isomers can be used singly or in mixtures. The [S,S] isomer is most preferred of the iron-EDDS complexes.

Other useful disuccinic acid chelating ligands are described in U.S. Pat. No. 5,691,120 (Wilson et al.).

Aminomonosuccinic acids (or salts thereof) are chelating ligands having at least one nitrogen atom to which a succinic acid (or salt) group is attached. These chelating ligands are also useful in iron complexes. U.S. Pat. No. 5,652,085 (Stickland et al.) also provides more details about such chelating ligands, particularly the polyamino monosuccinic acids such as eltylenediamine monosuccinic acid (EDMS).

Other classes of biodegradable aminopolycarboxylic acid or polyaminopolycarboxylic acid chelating ligands that can be used to form biodegradable iron complexes include iminodiacetic acid and its derivatives (or salts thereof, including alkyliminodiacetic acids that have a substituted or unsubstituted alkyl group having 1 to 6 carbon atoms (such as methyl, ethyl, n-propyl, hydroxymethyl, isopropyl, and t-butyl) as described in EP 0 532 003A1 (Kuse et al.). Particularly useful alkyliminodiacetic acids are methyliminodiacetic acid (MIDA) and ethyliminodiacetic acid (EIDA).

All chelating ligands useful in this invention can be present in the free acid form or as alkali metal (for example, sodium and potassium) or ammonium salts, or as mixtures thereof.

Still other biodegradable chelating ligands can be represented by the following Structure LIGAND:

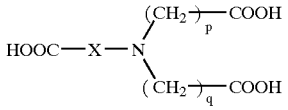

(LIGAND)

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

The iron-ligand complexes useful in this invention can be binary complexes (meaning iron is complexed to one or more molecules of a single chelating ligand) or ternary complexes in which iron is complexed to molecules of two distinct chelating ligands similar to iron complexes described for example in U.S. Pat. No. 5,670,305 (Gordon et al.) and U.S. Pat. No. 5,582,958 (noted above). A mixture of multiple binary or ternary iron complexes also can be present in the compositions.

Still other useful biodegradable iron chelating ligands include but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid, and tartaric acid.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" that is well known in the photographic processing art.

Ferric ions in the photographic bleaching agents can be provided from any conventional source including iron salts and iron oxides such as magnetite. The iron salts used to provide photographic bleaching compounds are generally ferric salts that provide a suitable amount of ferric ions for complexation with the chelating ligands defined above. Useful ferric salts include, but are not limited to, ferric ammonium sulfate, ferric sodium sulfate, ferric chloride, ferric nitrate, ferric bromide, ferric sulfate, ferric acetate, ferric oxalate, and ferric gluconate. Ferric nitrate is a preferred ferric salt. These salts can be provided in any suitable form, including various hydrated forms where they exist, and are available from a number of commercial sources.

Ferric ions can also be provided as ferrous ions that are oxidized at an appropriate time prior to or during use in an appropriate way as described in U.S. Pat. Nos. 6,582,893 and 6,534,253, [copending and commonly assigned U.S. Ser. No. 10/115,824 (filed Apr. 3, 2002, 2001 by Vincent et al. as a CIP of U.S. Ser. No. 09/723,794 (filed Nov. 28, 2000 by Vincent et al.), and in copending and commonly assigned U.S. Ser. No. 10/002820 (filed Nov. 15, 2001 by Kuykendall et al.),] both incorporated herein by reference.

It is not necessary that the ferric ion and the chelating ligand(s) be present in the photographic bleach-fixing compositions in stoichiometric proportions. It is preferred, however, that the molar ratio of the total chelating ligands to ferric ion be from about 1:1 to about 5:1. In a more preferred embodiment, the ratio is about 1:1 to about 2.5:1 moles of total chelating ligands per mole of ferric ion.

One or more rehalogenating agents may also present in the bleach-fixing compositions. Chloride, bromide, or iodide ions, or mixtures of halides are common halogenating agents. Such ions are provided in the form of water-soluble salts including ammonium, alkali metal and alkaline earth metal salts.

The photographic bleach-fixing compositions used in this invention are generally provided from two separate solutions ("parts") A and B described below that are mixed at an appropriate time. The resulting photographic replenisher solution can be delivered to a bleach-fixing processing chamber to provide or replenish a working strength processing solution that generally has a pH of from about 3.5 to about 8. A preferred pH is in the range of from about 5.5 to about 7.5. Alternatively, solutions A and B can be separately added to the processing chamber in the appropriate amounts described below.

The photographic bleach-fixing compositions also include one or more photographic fixing agents. Various "fixing" agents or silver solvents are known in the art but the preferred fixing agents are thiosulfates such as sodium thiosulfate, potassium thiosulfate, ammonium thiosulfate, lithium thiosulfate, calcium thiosulfate, magnesium thiosulfate, or mixtures thereof Preferably, ammonium thiosulfate or sodium thiosulfate (or a mixture thereof) is used.

Optionally, one or more thiocyanate fixing agents can also be present especially for more rapid silver removal. If present, it can be provided as sodium thiocyanate, potassium thiocyanate, or ammonium thiocyanate, or mixtures thereof.

A third essential component of the bleach-fixing composition used in the present invention is a sulfur-containing compound represented by any of the following Structures I, II, III, IVa, IVb, and V.

Thus, useful sulfur-containing compounds can be represented by (I)

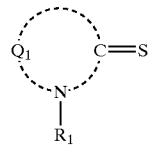

wherein $Q_1$ represents a group of atoms that are necessary to complete a substituted or unsubstituted nitrogen-containing heterocyclic ring including a ring condensed with a 5- or 6-membered unsaturated ring. In particular, $Q_1$ provides the atoms necessary to provide a pyrrole, pyrrolidine, pyrazole, pyrazolidine, imidazole, imidazoline, imidizolidine, triazole, triazoline, triazolidine, thiazole, thiazoline, thiazolidine, thiadiazole, thiadiazoline, thiadiazolidine, oxazole, oxazoline, oxazolidine, oxadiazole, oxadiazoline, oxadiazolidine, pyridine, piperidine, pyrazine, piperazine, pyrimidine, morpholine, azine, oxazine, dioxazine, thiazine, dithiazine, oxathiazine, diazine, oxadiazine, thiadiazine, or triazine heterocyclic ring. $R_1$ represents hydrogen, a substituted or unsubstituted alkyl group, a substituted or unsubstituted cycloalkyl group, a substituted or unsubstituted aryl group, a substituted or unsubstituted heterocyclic group including those each condensed with a 5- or 6-membered unsaturated ring, or an amino group. All of these groups are defined in more detail below.

Other useful sulfur-containing compounds are represented by (II)

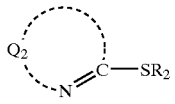

wherein $Q_2$ represents a group of atoms that are necessary to complete a substituted or unsubstituted nitrogen-containing heterocyclic ring including those each condensed with at 5- or 6-membered unsaturated ring. In particular, $Q_2$ provides the atoms necessary to provide a pyrrole, pyrrolidine, pyrazole, pyrazolidine, imidazole, irnidazoline, imidizolidine, triazole, triazoline, triazolidine, thiazole, thiazoline, thiazolidine, thiadiazole, thiadiazoline, thiadiazolidine, oxazole, oxazoline, oxazolidine, oxadiazole, oxadiazoline, oxadiazolidine, pyridine, piperidine, pyrazine, piperazine, pyrimidine, morpholine, azine, oxazine, dioxazine, thiazine, dithiazine, oxathiazine, diazine, oxadiazine, thiadiazine, or triazine heterocyclic ring. $R_2$ represents a hydrogen atom, an alkali metal atom, a

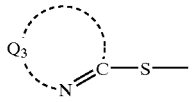

group wherein $Q_3$ is defined the same as $Q_2$, or a substituted or unsubstituted alkyl group.

Still other useful sulfur-containing compounds are represented by (III)

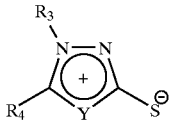

wherein $R_3$ and $R_4$ are independently substituted or unsubstituted alkyl groups, substituted or unsubstituted cycloalkyl groups, substituted or unsubstituted alkenyl groups, substituted or unsubstituted alkynyl groups, substituted or unsubstituted aralkyl groups, substituted or unsubstituted aryl groups, or substituted or unsubstituted heterocyclic groups, or $R_4$ can be hydrogen. Y is —O—, —S—, or —N(R5)— wherein $R_5$ is hydrogen, or a substituted or unsubstituted alkyl, substituted or unsubstituted cycloalkyl, substituted or unsubstituted alkenyl, substituted or unsubstituted alkynyl, substituted or unsubstituted aryl, substituted or unsubstituted heterocyclic, amino, substituted or unsubstituted acylamino, sulfonamido, substituted or unsubstituted ureido, or sulfamoylamino group. Alternatively, $R_3$ and $R_4$, or $R_4$ and $R_5$, taken together, may form a substituted or unsubstituted heterocyclic ring. Preferably, Y is —N($R_5$)— and $R_5$ is hydrogen, or a substituted or unsubstituted alkyl, substituted or unsubstituted alkenyl, substituted or unsubstituted alkynyl, or substituted or unsubstituted heterocyclic group.

Still additional useful sulfur-containing compounds are represented by the following Structures IVa and IVb:

(IVa)

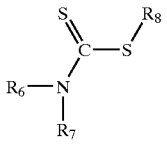

(IVb)

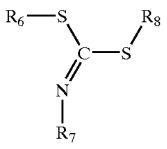

wherein Structures IVa and IVb represent tautomeric forms of the carbamodithioic acid or carbamodithioic ester functional group that may particularly coexist when $R_6$ is hydrogen or an alkali metal ion. Groups $R_6$, $R_7$, and $R_8$ independently represent hydrogen, alkali metal ions, or substituted or unsubstituted alkyl, substituted or unsubstituted cycloalkyl, substituted or unsubstituted alkenyl, substituted or unsubstituted alkynyl, substituted or unsubstituted aralkyl, substituted or unsubstituted aryl, substituted or unsubstituted heterocyclic, substituted or unsubstituted amino, acylamino, ureido, or sulfamoylamino groups.

In addition, the sulfur-containing compounds useful in this invention can be represented by Structure V:

(V)

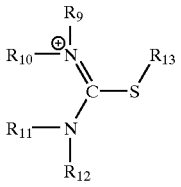

based on the functional group commonly known as an isothiuronium salt, but may also include deprotonated forms of the —S—C(=N)N— group. Groups $R_9$, $R_{10}$, $R_{11}$ and $R_{12}$ independently represent hydrogen, alkali metal ions, or substituted or unsubstituted alkyl, substituted or unsubstituted cycloalkyl, substituted or unsubstituted alkenyl, substituted or unsubstituted alkynyl, substituted or unsubstituted aralkyl, substituted or unsubstituted aryl, substituted or unsubstituted heterocyclic, substituted or unsubstituted amino, acylamino, ureido, or sulfamoylamino groups. Group $R_{13}$ represents a substituted or unsubstituted alkyl, substituted or unsubstituted cycloalkyl, substituted or unsubstituted alkenyl, substituted or unsubstituted alkynyl, substituted or unsubstituted aralkyl, substituted or unsubstituted aryl, substituted or unsubstituted heterocyclic, substituted or unsubstituted amino, acylamino, ureido, or sulfamoylamino group.

For the substituents in the noted Structures I, II, III, IVa, IVb, and V, the substituted or unsubstituted alkyl group substituents can have from 1 to 6 carbon atoms. Representative alkyl groups include, but are not limited to, methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, and phosphonoethyl groups. Preferred substituted or unsubstituted alkyl groups have 1 to 3 carbon atoms and can be substituted with amino or hydroxy groups.

The substituted or unsubstituted cycloalkyl substituents can have from 5 to 10 carbon atoms in the cyclic ring and include, for example, as cyclohexyl, cyclopentyl, and 2-methylcyclohexyl groups. Substituted or unsubstituted cyclohexyl groups are preferred.

The substituted or unsubstituted carbocyclic aryl groups can have from 6 to 10 carbon atoms in the aromatic ring and include, for example, phenyl, naphthyl, 4-methylphenyl, 4-methoxyphenyl, 4-carboxyphenyl, and 4-sulfophenyl groups. Substituted or unsubstituted phenyl groups are preferred.

The substituted or unsubstituted heterocyclic substituent groups in the noted Structures can have from 5 to 10 atoms including one or more of any of nitrogen, oxygen, and sulfur atoms, and the remaining atoms being carbon atoms. Such groups include, but are note limited to, 2-pyridyl, 3-pyridyl, 4-pyridyl, 2-thienyl, 1-pyrazolyl, 1-imidazolyl, and 2-tetrahydrofuryl groups. Preferred substituted and unsubstituted heterocyclic groups include the pyridyl groups.

The amino groups described above can be primary, secondary or tertiary amines having appropriate alkyl, aryl, or cycloalkyl groups attached to the amine nitrogen atom, and include for example primary amino, dimethylamino, and methylamino groups. Primary amino groups, and secondary and tertiary amino groups having alkyl group substituents with 1 to 3 carbon atoms are preferred.

Alkali metal ions useful in the sulfur-containing compounds of Structure II include lithium, sodium, potassium, and cesium metal ions. Sodium and potassium ions are preferred.

Substituted or unsubstituted alkenyl groups have 2 to 10 carbon atoms and include, for example, as allyl and 2-methylallyl groups. Substituted or unsubstituted alkynyl groups have 2 to 10 carbon atoms and include, for example, propargyl groups.

Substituted or unsubstituted aralkyl groups are really aryl substituted alkyl groups having 7 to 14 carbon atoms in the unsubstituted alkylaryl portion of the group. Representative aralkyl groups include, but are not limited to, benzyl, phenylethyl and 4-methoxybenzyl groups. The substituted or unsubstituted benzyl groups are preferred.

Representative substituted or unsubstituted acylamino groups are acetylamino, benzoylamino, and methoxypropionylamino groups. Representative substituted or unsubstituted ureido groups include unsubstituted ureido and 3-methylureido groups, and representative substituted or unsubstituted sulfamoylamino groups include unsubstituted sulfamoylamino and 3-methylsulfamoylamino groups.

It is also preferable that the sulfur-containing compound (cyclic or acyclic) compounds of Structure I, II, III, IVa, IVb, and V have a net neutral or positive charge in an aqueous solution at pH 6.2. This usually means that compounds having anionic groups are less desirable.

As noted above, the sulfur-containing compounds can be acyclic or cyclic in structure but the preferred compounds are 5- or 6-membered heterocyclic compounds comprising at least one nitrogen atom in the ring. More preferably, such cyclic compounds comprise a —N═C(SH)— or —NH—C(S═)— moiety as part of the ring. The heterocyclic rings can also include additional nitrogen atoms as well as carbon, oxygen, or sulfur atoms.

These heterocyclic compounds may have no substituents other than the mercapto moiety, but in some embodiments, the 5- or 6-membered ring is further substituted with one or more substituents as described above for Structures I, II, III, IVa, IVb, and V and especially alkyl groups.

Representative sulfur-containing compounds are the following sulfur-containing compounds (I) through (XIV):

(I)

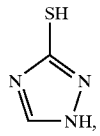

(II)

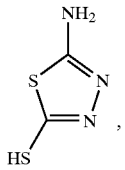

(III)

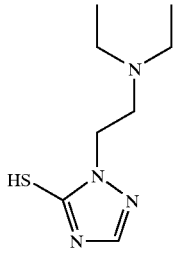

(IV)

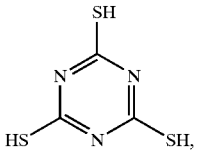

(V)

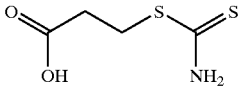

(VI)

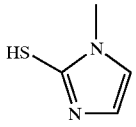

-continued (VII)

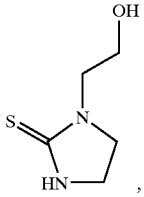

(VIII)

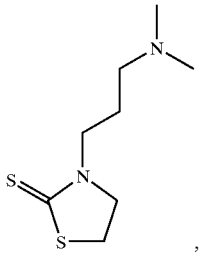

(IX)

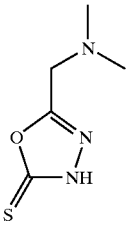

(X)

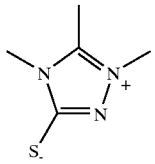

(XI)

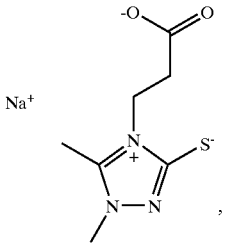

(XII)

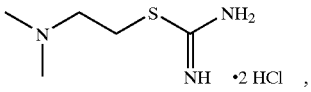

(XIII)

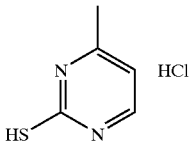

(XIV)

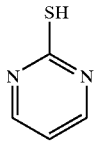

Mixtures of two or more of the sulfur-containing compounds can be present in the bleach-fixing compositions (and replenishers). Sulfur-containing compounds (I), (II), and (III) are preferred.

The compounds described above having a mercapto moiety are generally present in the bleach-fixing composition in an amount of at least 0.01 mmol/l and preferably in an amount of at least 0.04 mmol/l. The upper limit is generally 100 mmol/l and a preferred upper limit is 1 mmol/l.

The noted sulfur-containing compounds can be obtained in a number of ways. Some of them can be purchased from commercial sources such as Aldrich Chemical Company and Lancaster Synthesis Limited. Others can be prepared using common starting materials and synthetic procedures that would be apparent to one skilled in the art.

The bleach-fixing composition (and replenisher) used in the practice of the present invention is generally prepared by combining individual Solutions A and B at a volume ratio of from about 4:1 to about 0.5:1 (A:B), and preferably at a volume ratio of from about 3:1 to about 1:1 (A:B). The two solutions can be mixed to form a replenisher solution prior to delivery to the processing chamber at a rate of from about 5.4 ml/m$^2$ to about 215 ml/m$^2$, and preferably at a rate of from about 21.5 ml/m$^2$ to about 108 ml/m$^2$. Water can be added to this replenisher solution if desired at a volume ratio (relative to Solution A) of up to 1:20 (A:water), and preferably at a volume ratio of up to 1:10 (A:water).

Alternatively, Solutions A and B can be delivered individually (with or without a separate supply of water) to the processing chamber at a rate of from about 2.7 ml/m$^2$ to about 108 ml/m$^2$, and preferably independently at a rate of from about 5.4 ml/m$^2$ to about 54 ml/m$^2$. Water then may be added to the processing chamber to dilute the mixture of Solutions A and B. The volume of water added in this manner can be at a volume ratio (relative to Solution A) of up to 1:20 (A:water), and preferably at a volume ratio of up to 1:10 (A:water).

The three essential bleach-fixing photochemicals described herein can be provided in the individual Solutions A and B (concentrates) as shown in the following TABLE I. The concentrations (general and preferred) of the three essential components are listed in TABLE I below wherein all of the ranges of concentrations are considered to be approximate (that is "about" at the range end points).

TABLE I

| COMPONENT | CONCENTRATE SOLUTION | GENERAL (mol/l) | PREFERRED (mol/l) |
|---|---|---|---|
| Fix agent | A | 0.5 to 6 | 0.1 to 5 |
| Bleaching agent | B | 0.1 to 3 | 0.5 to 2 |
| Sulfur-containing Compound | A or B or both | 0.00005 to 0.5 | 0.0002 to 0.005 |

The amounts of the essential components in the working strength, replenisher compositions useful in the practice of this invention are shown in TABLE II below wherein all of the ranges of concentrations are considered to be approximate (that is "about" at the range end points) and the preferred amounts are shown in parentheses.

TABLE II

| COMPOSITION | COMPONENT | GENERAL (mol/l) | PREFERRED (mol/l) |
|---|---|---|---|
| Working Strength | Fixing agent | 0.1 to 5 | 0.2 to 2 |
| Working Strength | Bleaching agent | 0.02 to 2 | 0.05 to 0.3 |
| Working Strength | Sulfur-containing compound | 0.00001 to 0.1 | 0.00004 to 0.001 |
| Replenisher | Fixing Agent | 0.1 to 5 | 0.2 to 4 |
| Replenisher | Bleaching agent | 0.02 to 2.5 | 0.05 to 1.2 |
| Replenisher | Sulfur-containing Compound | 0.00001 to 0.4 | 0.00004 to 0.004 |

Optional addenda that can be present in the photographic bleach-fixing composition (and either or both of Solutions A and B) if desired are materials that do not adversely affect its photographic bleaching and fixing functions. Such materials include, but are not limited to, biocides, photographic hardeners, metal ion sequestering agents (such as polycarboxylic acids, polyaminopolycarboxylic acids, and polyphosphonic acids), buffers (such as acetic acid, succinic acid, glycolic acid, propionic acid, maleic acid, benzoic acid, sodium bisulfite, ammonium bisulfite, imidazole, maleic acid and EDTA), bleaching accelerators, fixing accelerators, preservatives, and other materials readily apparent to one skilled in the photographic art. These and other optional materials can be present in conventional amounts.

During photographic processing, conventional procedures can be used for replenishment of the various processing solutions, including the photographic bleach-fixing composition. Preferably, the rate of bleach-fixing composition replenishment is not more than 215 ml/m$^2$ of processed photographic color paper. The processing equipment can be any suitable processor having one or more processing tanks or chambers, including minilab processors and larger scale processors. The bleach-fixing step can be carried out in one or more chambers, tanks or stages arranged in concurrent or countercurrent flow.

The present invention can be used advantageously with any of the known methods of applying photographic bleach-fixing compositions to photographic materials. These methods include, but are not limited to, immersing a color paper in the aqueous bleach-fixing composition (with or without agitation or circulation), bringing the color paper into contact with a web or drum surface that is wet with the bleach-fixing composition, laminating the color paper with a cover sheet or web in such a way that the bleach-fixing composition is brought into contact with the color paper, or applying the bleach-fixing composition to the color paper by high velocity jet or spray.

Bleach-fixing can be generally carried out at a temperature of from about 20 to about 65° C. (preferably from about 30 to about 60° C.). The time of bleach-fixing is generally up to 60 seconds and preferably at least 10 and up to 40 seconds (more preferably from about 18 to about 35 seconds).

The other processing steps desired to provide color images can be similarly rapid or conventional in time and conditions. Preferably the other processing steps, such as color development and/or stabilizing (or rinsing), can be within a wide range of times. For example, color development can be carried out for from about 12 to about 360 seconds, and stabilizing (or rinsing) for from about 15 to about 240 seconds in various processing protocols. The bleach-fixing step can be carried out more than once in some processing methods. The processing methods can have any of a wide number of arrangements of steps, as described for example in U.S. Pat. No. 5,633,124 (noted above) that is incorporated herein by reference.

In rapid processing methods, the total processing time (all wet processing steps) for photographic color papers can be up to 100 seconds (preferably from about 40 to about 100 seconds).

The present invention can therefore be used to process silver halide color papers (or "positive" image forming materials) of various types for example using Process RA-4 processing conditions and protocols. The various processing sequences, conditions, and solutions for these processing methods are well known in the art, as well as obvious modifications thereof In some embodiments of this invention, an acidic stop solution can be used between color development and the bleach-fixing step. The "stop" solution generally is an aqueous solution having a pH below 7. Preferably, however, bleach-fixing is carried out immediately after color development, that is, without intervening processing steps.

Thus, one preferred processing method of the present invention for obtaining color images in photographic color papers includes the following individual processing steps, in order: color development, bleach-fixing, and rinsing and/or stabilizing.

Reagents for color development compositions are well known, and described, for example, in Research Disclosure (noted above), sections XVIII and XIX, and the many references described therein. Thus, besides a color developing agent (such as a p-aminophenol or p-phenylenediamine), the color developers can include one or more buffers, antioxidants (or preservatives, such as sulfo-, carboxy, and hydroxy-substituted mono- and dialkylhydroxylamines), antifoggants, fragrances, solubilizing, agents, brighteners, halides, sequestering agents, and other conventional addenda. Representative teaching about color developing compositions can also be found in U.S. Pat. No. 4,170,478 (Case et al.), U.S. Pat. No. 4,264,716 (Vincent et al.), U.S. Pat. No. 4,482,626 (Twist et al.), U.S. Pat. No. 4,892,804 (Vincent et al.), U.S. Pat. No. 5,491,050 (Brust et al.), U.S. Pat. No. 5,709,982 (Marrese et al.), U.S. Pat. No. 6,037,111 (Haye et al.), U.S. Pat. No. 6,017,687 (Darinon et al.), U.S. Pat. No. 6,077,651 (Darmon et al.), and U.S. Pat. No. 6,664,035 (Arcus et al.) [Ser. No. 09/706,474 (filed Nov. 3, 2000 by Arcus et al.)], all incorporated herein by reference.

A preferred photographic color developing composition has a pH of from about 9.5 to about 13 and comprises 4-(N-ethyl-N-2-methanesulfonylaminoethyl)-2-methylphenylenediamine sesquisulfate (KODAK Color Developing Agent CD-3), one or more hydroxylamine derivatives as antioxidants, and various addenda commonly included in such compositions.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al.), U.S. Pat. No. 5,441,852 (Hagiwara et al.), U.S. Pat. No. 5,529,890 (McGuckin et al.), U.S. Pat. No. 5,534,396 (McGuckin et al.), U.S. Pat. No. 5,578,432 (McGuckin et al.), U.S. Pat. No. 5,645,980 (McGuckin et al.), and U.S. Pat. No. 5,716,765 (McGuckin et al.), all incorporated herein by reference.

Solutions A and B used to make the photographic bleach-fixing composition useful in this invention can be provided in any suitable containers, and can also be provided in a processing kit alone or with one or more other photographic processing compositions (color developing, stabilizing, or rinsing compositions) in suitable containers.

The emulsions and other components, and structure of photographic color papers and other color "positive" materials processed using this invention and the various procedures for manufacturing them are well known and described in considerable publications, including, for example, *Research Disclosure*, publication 38957, pages 592–639 (September 1996), and *Research Disclosure*, Volume 370, February 1995, and hundreds of references noted therein. More details about such materials are provided herein below. In particular, the invention can be practiced with photographic color papers containing any of many varied types of silver halide crystal morphology, sensitizers, color couplers, and addenda known in the art, as described in the noted *Research Disclosure* publication and the many publications noted therein. The color papers can have one or more layers, at least one of which is a silver halide emulsion layer that is sensitive to electromagnetic radiation, disposed on a suitable resin-coated paper support. The supports can be subbed or unsubbed and coated with various antihalation, antistatic, or other non-imaging layers as is known in the art. Generally, the color papers are multi-color materials having three different color records comprising the appropriate color forming chemistry.

More preferably, the present invention is used to rapidly process three types of photographic multi-color papers:

(1) Color papers comprising at least one silver halide emulsion layer containing at least 0.3 mol % of silver iodide based on total silver halide in that emulsion layer. These color papers are generally known as "high iodide" color papers. Such color paper silver halide emulsions may have up to 3 mol % silver iodide (based on total silver halide). Examples of such silver halide emulsions are described for example in U.S. Pat. No. 5,543,281 (Isaac et al.), U.S. Pat. No. 5,314,798 (Brust et al.), U.S. Pat. No. 5,792,601 (Edwards et al.), and U.S. Pat. No. 6,248,507 (Budz et al.), all incorporated herein by reference.

(2) Color papers comprising a polyalkylene oxide compound such as a polyoxypropylene (POP) polyoxyethylene (POE) block copolymer in one or more layers (such as an ultraviolet light absorbing layer or silver halide emulsion layer). Examples of such color papers and polyalkylene oxide compounds are described for example in U.S. Pat. Nos. 6,319,658 (Lobo et al.) and 5,491,052 (Van Meter et al.), both incorporated herein by reference.

(3) Color papers comprising phenyl mercaptotetazole (PMT) or other mercaptotetrazoles in one or more silver halide emulsion layers, as described for example in U.S. Pat. Nos. 2,432,864 (Dimsdale et al.) and 4,912,026 (Miyoshi et al.), both incorporated herein by reference.

For example, the present invention can be used to provide color images in photographic color papers including, but not limited to, the following commercial products: KODAK® SUPRA ENDURA Color Papers, KODAK® PORTRA ENDURA Color Papers, KODAK® EKTACOLOR® EDGE 5, 7 and 8 Color Papers (Eastman Kodak Company), KODAK® ROYAL® VII Color Papers (Eastman Kodak Company), KODAK® PORTRA III, IIIM Color Papers (Eastman Kodak Company), KODAK® SUPRA III and IIIM Color Papers (Eastman Kodak Company), KODAK® ULTRA III Color Papers (Eastman Kodak Company), Fujicolor Super Color Papers (Fuji Photo Co., FA5, FA7, FA9, Type D and Type DII), Fujicolor Crystal Archive Color Papers (Fuji Photo Co., Digital Paper Type DP, Professional Paper Type DP, Professional Type CD, Professional Type CDII, Professional Type PD, Professional Type PDII, Professional Type PIII, Professional Type SP, Type One, Professional Paper Type MP, Type D and Type C), Fuji Prolaser (Fuji Photo Co.), KONICA COLOR QA Color Papers (Konica, Type QA6E and QA7, Type AD Amateur Digital, Type CD Professional Digital), Konica Color Paper Professional SP (Konica), Konica Color Paper Professional HC (Konica), Konica Color Paper Professional for Digital Type CD (Konica), Agfa Prestige Color Papers (AGFA, Digital and Prestige II), Agfa Laser II Paper (AGFA), Agfa Professional Portrait (AGFA), Agfa Professional Signum H (AGFA), Mitsubishi Color Paper SA Color Papers (Mitsubishi, Type SA-C, Type SA-PRO-L and Type SA-PRO-H). The compositions and constructions of such commercial photographic color papers would be readily determined by one skilled in the art.

KODAK® DURATRANS®, KODAK® DURACLEAR, KODAK® EKTAMAX RA and KODAK® DURAFLEX transparent photographic color positive materials and KODAK® Digital Paper Type 2976 can also be processed using the present invention.

The following examples are provided to illustrate the practice of the present invention and are not meant to be limiting in any way.

COMPARATIVE EXAMPLE 1

A two-part bleach-fixing kit outside of the present invention was used to prepare a photographic bleach-fixing composition useful for photographic processing. The two solutions in the kit comprised the following components and volumes:

| | |
|---|---|
| Solution A (1730 ml): | |
| Sodium metabisulfite | 139 g |
| Ammonium thiosulfate | 785 g |
| Ammonium sulfite | 55.6 g |
| Glacial acetic acid | 16.3 g |
| Water | to 1730 ml |
| Solution B (920 ml): | |
| Ferric ammonium EDTA | 514 g |
| Water | to 920 ml |

Solutions A and B were mixed in a vessel with sufficient water to provide 7.5 liters of a replenisher bleach-fixing composition having a pH of 6.4.

This solution was supplied to a processing tank (chamber) during photographic processing at a rate of 100 ml/m$^2$ to provide a working strength bleach-fixing composition.

The two bleach-fixing solutions were provided with a color developing concentrate and a stabilizing/rinsing concentrate (both described below) in a four-part processing kit. The color developing and the stabilizing/rinsing concentrates were individually added to processing tanks and mixed with appropriate amounts of water to provide desired compositions that were supplied to the processing tanks during photographic processing to provide working strength solutions.

Samples of various commercial photographic color papers (described below) were processed using the following protocol and processing solutions shown in the following TABLE III:

TABLE III

| Processing Solution | Processing Time (seconds) | Processing Temperature (° C.) | Replenishment Rate (ml/m$^2$) |
|---|---|---|---|
| Color developing | 33 | 40 | 60 |
| Bleach-fixing | 33 | 38 | 100 |
| Stabilizing/rising | 69 | 37 | 200 |

Color developing was carried out using a concentrated single-part color developer as described in U.S. Pat. No. 6,077,651 (Darnon et al.), incorporated by reference. Stabilizing/rinsing was carried out using the following concentrated solution:

| | |
|---|---|
| Stabilizer/Rinse: | |
| Water | 908.7 g/l |
| Glacial acetic acid | 1.98 g/l |
| Sodium hydroxide (50% solution) | 1.2 g/l |
| Copper nitrate (41% solution) | 1.39 g/l |
| Poly(vinyl pyrrolidone) K-15 | 29.68 g/l |
| Kathon ™ LX biocide solution | 51.23 g/l |
| Empicol ESC3A2 anionic sulfate surfactant | 24.45 g/l |

The processor containing the three processing compositions was "seasoned" by processing samples of commercially available Kodak® Digital® III color paper to three tank turn-overs of the color developing composition, which equals five bleach-fixing tank turn-overs.

Sensitometrically exposed samples of color papers A–C were then processed at five bleach-fixing tank turn-overs. Color paper A contained less phenylmercaptotetraazole (PMT) than color papers B and C, and did not contain a polyalkylene oxide compound like color papers B and C. Color paper B had less silver than color paper C. The performance of the bleach-fixing composition was monitored by measuring the IR density at 1000 nm and is reported as the difference (Δ) in $D_{max}$ and $D_{min}$ areas of the color paper samples. Previous examination of color paper prints (images) had established an upper limit for the difference in IR density to be less than 0.06. The results for these experiments are shown in TABLE IV below.

TABLE IV

| Color Paper | $D_{min}$ | $D_{max}$ | Δ IR Density |
|---|---|---|---|
| A | 0.87 | 0.90 | 0.03 |
| B | 0.87 | 0.93 | 0.06 |
| C | 0.87 | 0.94 | 0.07 |

It can be seen that this comparative method using known processing solutions did not adequately remove the silver from some of the noted color papers during rapid bleach-fixing.

COMPARATIVE EXAMPLE 2

Since the method described in Comparative Example 1 was not satisfactory in silver removal, attempts were made to improved the process by using conventional techniques such as increasing the components of the bleaching and fixing agents and/or decreasing bleach-fixing pH. However, these techniques may not be possible with all processing systems, especially those using prepackaged processing solutions that have fixed volumes. In addition, pH adjustments are not always possible because the stability of the solutions may be adversely affected.

Another two-part bleach-fixing kit outside of the present invention was used to prepare a photographic bleach-fixing composition useful for photographic processing. The two solutions in the kit comprised the following components and volumes:

| | |
|---|---|
| Solution A (2000 ml): | |
| Sodium metabisulfite | 200 g |
| Ammonium thiosulfate | 994.4 g |
| Ammonium sulfite | 70.4 g |

-continued

| | |
|---|---|
| Glacial acetic acid | 23.4 |
| Water | to 2000 ml |
| Solution B (1000 ml): | |
| Ferric ammonium EDTA | 562.6 g |
| Glacial acetic acid | 4.2 g |
| Water | to 1000 ml |

Solutions A and B were mixed in a vessel with sufficient water to provide 7.5 liters of a replenisher bleach-fixing composition having a pH of 6.1.

The two bleach-fixing solutions were provided with a color developing concentrate and a stabilizing/rinsing concentrate (both described below) in a four-part processing kit. The color developing and the stabilizing/rinsing concentrates were individually added to processing tanks and mixed with appropriate amounts of water to provide desired replenisher compositions.

Samples of various photographic color papers (described below) were processed using the protocol and processing solutions described above for Comparative Example 1.

The processor containing the three processing compositions was "seasoned" by processing samples of commercially available Kodak® Digital® III color paper to three tank turn-overs of the color developing composition, which equals five bleach-fixing tank turn-overs.

Sensitometrically exposed samples of color papers A, D, E, F, and G were also sensitometrically exposed and processed periodically throughout the experiment. The order of concentration of PMT coated in the color papers was G<A<D=E<F. The order of concentration of silver iodide in the color papers was A=F<D=E=G. Color paper A did not contain a polyalkylene oxide compound whereas the remaining papers contained equal concentrations of a polyalkylene oxide compound.

The performance of the bleach-fixing composition was monitored by measuring the IR density at 1000 nm and is reported as the difference (Δ) in $D_{max}$ and $D_{min}$ areas of the color paper samples. Previous examination of color paper prints (images) had established an upper limit for the difference in IR density to be less than 0.06. The results (Δ IR Density) for these experiments are shown in TABLE V below.

TABLE V

| | Δ IR Density | | | | |
|---|---|---|---|---|---|
| % Seasoned Bleach-Fix | Color Paper A | Color Paper D | Color Paper E | Color Paper F | Color Paper G |
| 5% | 0.02 | 0.02 | 0.03 | 0.02 | 0.03 |
| 24% | 0.03 | 0.06 | 0.06 | 0.09 | 0.05 |
| 33% | 0.03 | 0.06 | 0.07 | | |
| 48% | 0.03 | 0.03 | 0.02 | | 0.05 |
| 76% | 0.02 | 0.06 | 0.03 | | |
| 100% | 0.03 | 0.05 | 0.04 | 0.03 | 0.04 |
| 143% | 0.03 | 0.04 | 0.04 | 0.05 | |

It can be seen that this comparative method using known processing solutions did not adequately remove the silver from some of the noted color papers during rapid bleach-fixing.

Example 1

A two-part bleach-fixing kit of the present invention was used to prepare a photographic bleach-fixing composition useful for rapid photographic processing according to the present invention. The two solutions in the kit comprised the following components and volumes:

| | |
|---|---|
| Solution A (2000 ml): | |
| Sodium metabisulfite | 200 g |
| Ammonium thiosulfate | 994.4 g |
| Ammonium sulfite | 70.4 g |
| Glacial acetic acid | 23.4 |
| Water | to 2000 ml |
| Solution B (1000 ml): | |
| Ferric ammonium EDTA | 562.6 g |
| Glacial acetic acid | 4.2 g |
| 3H-1,2,4-Triazole-3-thione,1,2-dihydro | 0.182 g |
| Water | to 1000 ml |

Solutions A and B were mixed in a vessel with sufficient water to provide 7.5 liters of a replenisher bleach-fixing composition having a pH of 6.2. This solution was replenished into the processing tank during photographic processing at a rate of 100 ml/$m^2$ to yield a working strength composition.

Solutions A and B were provided with a color developing concentrate and a stabilizing/rinsing concentrate (both described below) in a four-part processing kit. The color developing and the stabilizing/rinsing concentrates were individually added to replenisher tanks and mixed with appropriate amounts of water to provide replenisher solutions that were delivered to the appropriate processing tanks during photographic processing to yield working strength solutions.

Samples of various commercial photographic color papers (described below) were processed using the protocol and processing solutions described above for Comparative Example 1 except that the color developing concentrate composition used was commercially available Agfa d-lab.2 easy PAPER CHEMICALS Solution CD-R.

The processor containing the three working strength processing compositions was "seasoned" by processing samples of commercially available Kodak® Digital® III color paper to three tank turn-overs of the color developing composition, which equals five bleach-fixing tank turnovers.

Sensitometrically exposed samples of several color papers were then processed to five bleach-fix tank turnovers. The order of concentration of PMT coated in the color papers was G<A<D<C<F. The order of concentration of silver iodide coated in the color papers was A=F<C=D=G. Color paper A did not contain a polyalkylene oxide compound, whereas the remaining color papers contained equal concentrations of a polyalkylene oxide compound.

The performance of the bleach-fixing composition was monitored by measuring the IR density at 1000 nm and is reported as the difference (Δ) in $D_{max}$ and $D_{min}$ areas of the color paper samples. Previous examination of color paper prints (images) had established an upper limit for the difference in IR density to be less than 0.06. The results (Δ IR Density) for these experiments are shown in TABLE VI below.

TABLE VI

| % Seasoned with Example 1 Solution | Δ IR Density Color Paper A | Color Paper C | Color Paper D | Color Paper F | Color Paper G |
|---|---|---|---|---|---|
| | Seasoned Solution from Comparative Example 2 | | | | |
| | 0.04 | 0.04 | 0.06 | 0.05 | 0.04 |
| 5% | 0.04 | 0.03 | 0.05 | 0.04 | 0.05 |
| 10% | 0.03 | 0.04 | 0.05 | 0.04 | 0.04 |
| 14% | 0.04 | 0.03 | 0.04 | 0.03 | 0.03 |
| 19% | 0.03 | 0.02 | 0.04 | 0.03 | 0.02 |
| 24% | 0.03 | 0.03 | 0.03 | 0.02 | 0.02 |
| 29% | 0.02 | 0.02 | 0.04 | 0.03 | 0.02 |
| 33% | 0.03 | 0.03 | 0.03 | 0.03 | 0.03 |
| 38% | 0.02 | 0.03 | 0.03 | 0.03 | 0.03 |
| 43% | 0.03 | 0.02 | 0.03 | 0.03 | 0.03 |
| 48% | 0.03 | 0.02 | 0.03 | 0.03 | 0.03 |
| 52% | 0.03 | 0.02 | 0.03 | 0.03 | 0.03 |
| 57% | 0.03 | 0.02 | 0.03 | 0.03 | 0.03 |
| 62% | 0.03 | 0.03 | 0.03 | 0.02 | 0.03 |
| 67% | 0.02 | 0.03 | 0.02 | 0.03 | 0.02 |
| 71% | 0.02 | 0.02 | 0.03 | 0.03 | 0.02 |
| 76% | 0.03 | 0.02 | 0.03 | 0.02 | 0.03 |
| 81% | 0.02 | 0.02 | 0.03 | 0.03 | 0.02 |
| 86% | 0.03 | 0.02 | 0.02 | 0.03 | 0.03 |
| 90% | 0.03 | 0.02 | 0.03 | 0.03 | 0.02 |
| 95% | 0.03 | | 0.02 | 0.03 | 0.02 |
| 100% | 0.01 | | 0.03 | 0.03 | 0.02 |
| 105% | 0.02 | | 0.03 | 0.03 | 0.02 |
| 110% | 0.02 | | 0.03 | 0.03 | 0.02 |
| 114% | 0.03 | 0.01 | 0.03 | 0.03 | 0.03 |
| 119% | 0.02 | 0.03 | 0.03 | 0.03 | 0.02 |
| 124% | 0.02 | 0.01 | 0.02 | 0.03 | 0.02 |
| 129% | 0.02 | 0.02 | 0.02 | 0.02 | 0.02 |
| 133% | 0.02 | | 0.03 | 0.02 | 0.03 |
| 138% | 0.03 | | 0.03 | 0.02 | 0.03 |
| 143% | 0.02 | | 0.03 | 0.02 | 0.02 |
| 148% | 0.03 | | 0.02 | 0.03 | 0.02 |
| 152% | 0.04 | | 0.02 | 0.03 | 0.02 |
| 157% | 0.01 | | 0.02 | 0.03 | 0.02 |
| 162% | 0.03 | | 0.03 | 0.02 | 0.03 |
| 167% | 0.02 | | 0.02 | 0.03 | 0.02 |
| 171% | 0.02 | | 0.03 | 0.02 | 0.03 |

The data in TABLE VI show that the presence of the sulfur-containing compound in the bleach-fixing composition, as provided from solution B, improves bleach-fixing such that silver was removed from all color papers in the short processing time. The method of this Example successfully removed silver from the examined color papers whereas the bleach-fixing composition of Comparative Example 2 did not.

Example 2

A fresh bleach-fixing solution was prepared having the composition shown in TABLE VII below.

TABLE VII

| Component | Concentration (g/l) |
|---|---|
| Sodium metabisulfite | 14.3 |
| Ammonium sulfite | 5.0 |
| Ammonium thiosulfate | 71.0 |
| Glacial acetic acid | 26.7 |
| Ammonium Fe-EDTA | 37.7 |
| EDTA | 3.2 |
| 1-Phenyl-5-mercapto-tetrazole | 0.025 |

Sulfur-containing Compound (I) was added in aliquots to the composition of TABLE VII, as shown below in TABLE VIII to provide bleach-fixing (B/F) solutions 1–6. Bleach-fixing solution 7 is a composition like that shown in TABLE VII but with the 1-phenyl-5-mercapto-tetrazole omitted. Thus, B/F solutions 1 and 7 are Controls and B/F solutions 2–6 are within the scope of the present invention.

TABLE VIII

| Solution | Compound I (g/l) |
|---|---|
| 1 | 0.000 |
| 2 | 0.025 |
| 3 | 0.020 |
| 4 | 0.015 |
| 5 | 0.010 |
| 6 | 0.005 |
| 7 | 0.000 |

Color development and stabilizing steps were carried out using the compositions shown in Comparative Example 1 and the following processing conditions.

| | | |
|---|---|---|
| Color development | 45 seconds | 35° C. |
| Bleach-fixing | 15–60 seconds | 35° C. |
| Stabilizing/rinsing | 90 seconds | 35° C. |

Imagewise exposed samples of color papers C, D, F, and G were processed in a similar fashion. The order of concentration of PMT provided in the these color papers was G<D<C<F. The order of concentration of silver iodide in those color papers was F<C=D=G. All of the color papers contained equal concentrations of a polyalkylene oxide compound.

The performance of the bleach-fixing composition was monitored by measuring the IR density at 1000 nm and is reported as the difference (Δ) in $D_{max}$ and $D_{min}$ areas of the color paper samples. Previous examination of color paper prints (images) had established an upper limit for the difference in IR density to be less than 0.06. The results (Δ IR Density) for these experiments are shown in the following TABLE IX for the tested color papers.

TABLE IX

| Solution | Δ IR Density 35 Second Bleach-fixing Time Color Paper C | Color Paper D | Color Paper F | Color Paper G |
|---|---|---|---|---|
| 1 | 0.25 | 0.16 | 0.21 | 0.18 |
| 2 | 0.02 | 0.00 | 0.00 | 0.00 |
| 3 | 0.06 | 0.01 | 0.03 | 0.02 |
| 4 | 0.10 | 0.01 | 0.08 | 0.02 |
| 5 | 0.13 | 0.05 | 0.09 | 0.07 |
| 6 | 0.23 | 0.12 | 0.22 | 0.19 |
| 7 | 0.00 | 0.00 | 0.00 | 0.00 |

These data show that mercaptotetazole compounds such as PMT, which may season into the bleach-fix solution from color papers during processing, inhibit bleach-fixing of the color papers. Addition of sulfur-containing compound (I) to the bleach-fixing composition according to the present invention overcomes this effect.

Example 3

Sensitometrically exposed samples of two photographic color papers were processed using a tank processor. One color paper used was commercially available KODAK® Edge® 8. The other color paper was a similar material except wherein the blue light-sensitive emulsion color record (one or more layers) was replaced with a silver chloroiodide emulsion having a silver iodide content of 0.50 mol % (based on total silver halide in that color record). This silver halide emulsion was prepared like that described in Example 6 of U.S. Pat. No. 6,248,507 (Budz et al.), incorporated herein by reference. This color paper would be considered a "high iodide paper". The process used for comparison was either the standard RA-4 color paper processing method (TABLE X below), or a "modified" RA-4 color paper process.

TABLE X

| Process step | Solution | Time | Temperature |
|---|---|---|---|
| Color Development | KODAK ® RA-12 Developer | 45 seconds | 37.8° C. |
| Bleach-fixing | KODAK ® RA-4 Bleach-Fix | 45 seconds | 37.8° C. |
| Washing | Tap water | 90 seconds | 36.7° C. |

The "modified" RA-4 process was identical to the standard RA-4 process, with the only exception being that sulfur-containing compounds represented by Structures I to III were added to KODAK RA-4 bleach-fix solution. The performance of the standard and "modified" bleach-fixing composition was monitored by measuring the IR density at 1000 nm and is reported as the difference (Δ) in $D_{max}$ and $D_{min}$ areas of the color paper samples (TABLE XI below).

TABLE XI

| Color Paper Type | Sulfur-containing Compound (amount) | Δ IR Density | Comment |
|---|---|---|---|
| KODAK ® Edge ® 8 | None (0) | 0.01 | Comparison |
| High Iodide Paper | None (0) | 0.09 | Comparison |
| High Iodide Paper | I (0.5 g/l) | 0.01 | Invention |
| High Iodide Paper | II (0.5 g/l) | 0.00 | Invention |
| High Iodide Paper | III (0.5 g/l) | 0.01 | Invention |
| High Iodide Paper | IV (0.5 g/l) | 0.01 | Invention |
| High Iodide Paper | VI (0.5 g/l) | 0.03 | Invention |
| High Iodide Paper | VII (0.5 g/l) | 0.03 | Invention |
| High Iodide Paper | VIII (0.5 g/l) | 0.04 | Invention |
| High Iodide Paper | IX (0.5 g/l) | 0.04 | Invention |
| High Iodide Paper | X (0.5 g/l) | 0.04 | Invention |
| High Iodide Paper | XI (0.5 g/l) | 0.06 | Invention |

These data show that, while there is no problem with bleaching silver in many conventional color papers, there may be a problem with silver bleaching when the color papers contain relatively higher amounts of silver iodide in one or more emulsions. These data also show that some compounds may be preferred over others depending upon the environment in which they are used and the color papers they are used to process.

Example 4

Sensitometrically exposed samples of Color Paper D (noted above) were processed using a tank processor and the standard RA-4 color paper processing method (Table IX above). However, instead of fresh KODAK RA-4 Bleach-fix, a simulated highly seasoned bleach-fixing composition was used. This simulated highly seasoned bleach-fixing composition was a mixture of normally seasoned bleach fix (as described in Comparative Example 1) and 16.8 mg/l of the sodium salt of 1-phenyl-5-mercaptotetrazole. To illustrate the invention, sulfur-containing compounds of Structures I, II, III, IVa, and IVb were added to the simulated highly seasoned bleach-fixing composition. The performance of the bleach-fixing compositions was monitored by measuring the IR density at 1000 nm and is reported as the difference (Δ) in $D_{max}$ and $D_{min}$ areas of the color paper samples (TABLE XII below).

TABLE XII

| Sulfur-containing Compound (g/l) | Δ IR Density | Comment |
|---|---|---|
| None (0) | 0.12 | Comparison |
| I (0.05) | 0.00 | Invention |
| V (0.5) | 0.01 | Invention |
| XII (0.5) | 0.01 | Invention |
| XIII (0.5) | 0.01 | Invention |
| XIV (0.5) | 0.00 | Invention |

These data show that certain sulfur-containing compounds, such as mercaptotetrazole compounds, that may be present in certain color papers, may season into bleach-fixing solutions during photographic processing. When that happens, these mercaptotetrazole compounds may inhibit silver removal. Addition of the sulfur-containing compounds defined by Structures I, II, III, IVa, IVb, and V as described herein to the bleach-fixing solution appear to reduce or eliminate this effect.

The invention has been described in detail with particular reference to certain preferred embodiments thereof, but it will be understood that variations and modifications can be effected within the spirit and scope of the invention.

We claim:

1. A method of providing a color photographic image comprising contacting a color developed photographic color paper in a processing chamber with a photographic bleach-fixing composition that has a pH of from about 3.5 to about 8 and comprises:

from about 0.02 to about 2 mol/l of a ferric-ligand photographic bleaching agent, from about 0.1 to about 5 mol/l of a photographic fixing agent that is a thiosulfate, thiocyanate, or a mixture thereof, and from about 0.01 to about 100 mmol/l of a sulfur-containing compound represented by one or more of the following Structures I, II, III, IVa, IVb, and V:

(I)

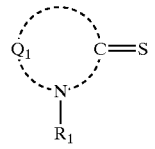

wherein $Q_1$ represents a group of atoms that are necessary to complete a substituted or unsubstituted nitrogen-containing heterocyclic ring, and $R_1$ represents hydrogen, or an alkyl, cycloalkyl, aryl, heterocyclic, or amino group, (II)

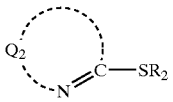

wherein $Q_2$ represents a group of atoms that are necessary to complete a substituted or unsubstituted nitrogen-containing heterocyclic ring, and $R_2$

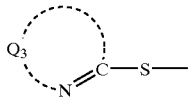

represents hydrogen, an alkali metal atom, a group wherein $Q_3$ is defined the same as $Q_2$, or an alkyl group, (III)

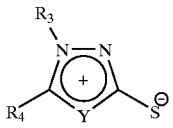

wherein $R_3$ and $R_4$ are independently alkyl, cycloalkyl, alkenyl, alkynyl, aralkyl, aryl, or heterocyclic groups, or $R_4$ can be hydrogen, and Y is —O—, —S—, or —N($R_5$)— wherein $R_5$ is an alkyl, cycloalkyl, alkenyl, alkynyl, aryl, heterocyclic, amino, acylamino, sulfonamido, ureido, or sulfamoylamino group, or $R_3$ and $R_4$, or $R_4$ and $R_5$, taken together, independently, may form a heterocyclic ring, (IVa)

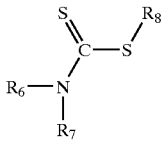

(IVb)

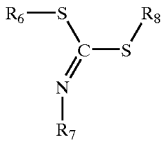

wherein $R_6$, $R_7$, and $R_8$ independently represent hydrogen, alkali metal ions, or alkyl, cycloalkyl, alkenyl, alkynyl, aralkyl, aryl, heterocyclic, amino, acylamino, ureido, or sulfamoylamino groups, and (V)

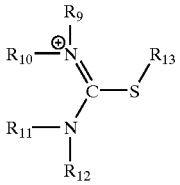

wherein $R_9$, $R_{10}$, $R_{11}$ and $R_{12}$ independently represent hydrogen, alkali metal ions, or alkyl, cycloalkyl, alkenyl, alkynyl, aralkyl, aryl, heterocyclic, amino, acylamino, ureido, or sulfamoylamino groups, and $R_{13}$ represents an alkyl, cycloalkyl, alkenyl, alkynyl, aralkyl, aryl, heterocyclic, amino, acylamino, ureido, or sulfamoylamino group, said bleach-fixing composition provided by delivery to said processing chamber of Solutions A and B, wherein Solution A comprises from about 0.5 to about 6 mol/l of said photographic fixing agent, and Solution B comprises from about 0.1 to about 3 mol/l of said ferric-ligand photographic bleaching agent, and either or both of said Solutions A and B comprise from about 0.05 to about 500 mmol/l of said sulfur-containing compound defined by Structures I, II, II, IVa, IVb, or V above, Solutions A and B being delivered to said processing chamber at a volume ratio of from about 4:1 to about 0.5:1 (A:B), and said contacting being carried out for from about 10 to about 60 seconds.

2. The method of claim 1 wherein said Solutions A and B are diluted with water upon delivery to said processing chamber at a volume ratio relative to Solution of up to 1:20 (A:water).

3. A method of providing a color photographic image comprising contacting a color developed photographic color paper in a processing chamber with a photographic bleach-fixing composition that has a pH of from about 3.5 to about 8 and comprises:

from about 0.02 to about 2 mol/l of a ferric-ligand photographic bleaching agent, from about 0.1 to about 5 mol/l of a photographic fixing agent that is a thiosulfate, thiocyanate, or a mixture thereof, and from about 0.01 to about 100 mmol/l of a sulfur-containing compound represented by one or more of the following Structures I, II, III, IVa, IVb, and V:

(I)

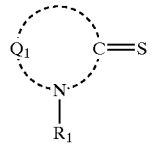

wherein $Q_1$ represents a group of atoms that are necessary to complete a nitrogen-containing heterocyclic ring, and $R_1$ represents hydrogen, or an alkyl, cycloalkyl, aryl, heterocyclic, or amino group, (II)

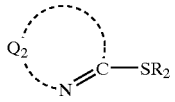

wherein $Q_2$ represents a group of atoms that are necessary to complete a nitrogen-containing heterocyclic ring, and $R_2$ represents hydrogen, an alkali metal atom, a

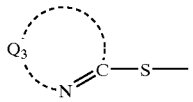

group wherein $Q_3$ is defined the same as $Q_2$, or an alkyl group, (III)

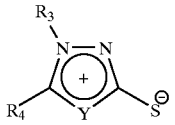

wherein $R_3$ and $R_4$ are independently alkyl, cycloalkyl, alkenyl, alkynyl, aralkyl, aryl, or heterocyclic groups, or $R_4$ can be hydrogen, and Y is —O—, —S—, or —N($R_5$)— wherein $R_5$ is an alkyl, cycloalkyl, alkenyl, alkynyl, aryl, heterocyclic, amino, acylamino, sulfonamido, ureido, or sulfamoylamino group, or $R_3$ and $R_4$, or $R_4$ and $R_5$, taken together, independently, may form a heterocyclic ring, (IVa)

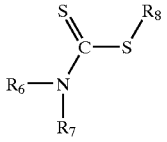

(IVb)

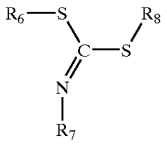

wherein $R_6$, $R_7$, and $R_8$ independently represent hydrogen, alkali metal ions, or alkyl, cycloalkyl, alkenyl, alkynyl, aralkyl, aryl, heterocyclic, amino, acylamino, ureido, or sulfamoylamino groups, and (V)

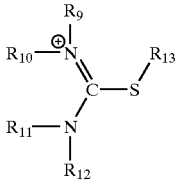

wherein $R_9$, $R_{10}$, $R_{11}$ and $R_{12}$ independently represent hydrogen, alkali metal ions, or alkyl, cycloalkyl, alkenyl, alkynyl, aralkyl, aryl, heterocyclic, amino, acylamino, ureido, or sulfamoylamino groups, and $R_{13}$ represents an alkyl, cycloalkyl, alkenyl, alkynyl, aralkyl, aryl, heterocyclic, amino, acylamino, ureido, or sulfamoylamino group, said bleach-fixing composition provided by delivery to said processing chamber of a bleach-fixing replenisher at a rate of from about 5.4 to about 215 ml/m$^2$, said bleach-fixing replenisher provided by mixing individual Solutions A and B, wherein Solution A comprises from about 0.5 to about 6 mol/l of said photographic fixing agent, and Solution B comprises from about 0.1 to about 3 mol/l of said ferric-ligand photographic bleaching agent, and either or both of Solutions A and B comprise from about 0.05 to about 500 mmol/l of said sulfur-containing compound, said Solution A being mixed with said Solution B at a volume ratio of from about 4:1 to about 0.5:1 (A:B), and said contacting being carried out for from about 10 to about 60 seconds.

4. The method of claim 3 wherein said bleach-fixing replenisher is mixed with water at a volume ratio relative to Solution A of up to 1:20.

5. The method of claim 3 wherein said photographic bleach-fixing composition has a pH of from about 5.5 to about 7.5.

6. The method of claim 3 wherein said ferric-ligand photographic bleaching agent is present in said photographic bleach-fixing composition in an amount of from about 0.05 to about 0.3 mol/l, and said photographic fixing agent is present in said photographic bleach-fixing composition in an amount of from about 0.2 to about 2 mol/l.

7. The method of claim 3 wherein said Solutions A and B are mixed at a volume ratio of from about 3:1 (A:B) to about 1:1 (A:B).

8. The method of claim 3 wherein said sulfur-containing compound is represented by any of Structures I, II, III, IVa, or IVb and has a net neutral or positive charge in an aqueous solution at pH 6.2.

9. The method of claim 8 wherein said sulfur-containing compound is a 5- to 6-membered N-heterocyclic compound having no other substituents besides the mercapto moiety.

10. The method of claim 8 wherein said sulfur-containing compound is a 5- or 6-membered N-heterocyclic compound comprising one or more alkyl substituents on the cyclic ring.

11. The method of claim 3 wherein said sulfur-containing compound is one or more of the following compounds (I) through (XIV):

(I)

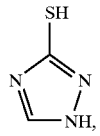

(II)

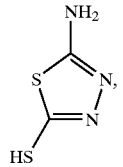

(III)

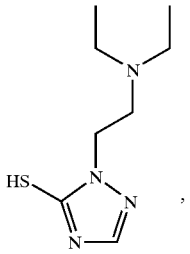

(IV)

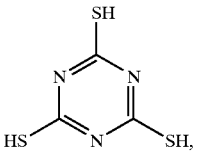

(V)

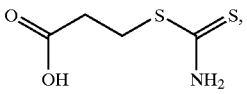

(VI)

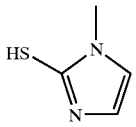

(VII)

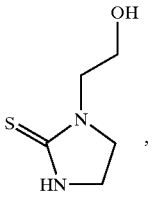

-continued (VIII)

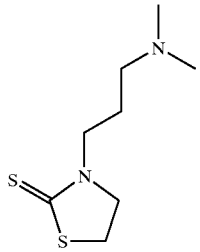

(IX)

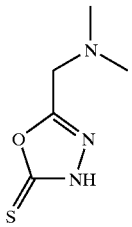

(X)

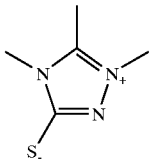

(XI)

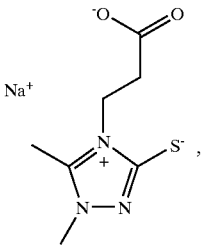

(XII)

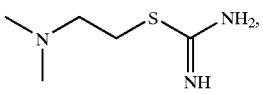

•2 HCl (XIII)

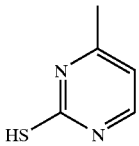

HCl

, and (XIV)

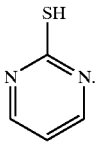

12. The method of claim 3 wherein said sulfur-containing compound is present in said photographic bleach-fixing composition in an amount of from about 0.04 to about 1 mmol/l.

13. The method of claim 3 wherein said photographic color paper comprises a silver halide emulsion comprising at least 0.3 mol % silver iodide based on total silver halide in said emulsion, a polyalkylene oxide compound, or a mercaptotetrazole.

14. The method of claim 3 wherein said ferric-ligand photographic bleaching agent is an iron complex of an aminopolycarboxylic acid or a polyaminopolycarboxylic acid.

15. The method of claim 14 wherein said ferric-ligand photographic bleaching agent is an iron complex of ethylenediaminetetraacetic acid, ethylenediaminedisuccinic acid, or 1,3-propylenediaminetetraacetic acid.

16. The method of claim 3 wherein said contacting is carried out for from about 18 to about 35 seconds.

17. The method of claim 3 wherein said bleach-fixing contacting follows color development immediately without any intervening steps.

18. The method of claim 3 wherein said bleach-fixing contacting is followed by one or more stabilizing or rinsing steps.

19. A method for providing a color photographic image comprising:

A) color developing an imagewise exposed photographic color paper using a color developing composition, said photographic color paper comprising a silver halide emulsion comprising at least 0.3 mol % silver iodide based on total silver halide in said emulsion, a polyalkylene oxide compound, or a mercaptotetrazole, B) bleach-fixing said color developed photographic color paper in a processing chamber with a photographic bleach-fixing composition having a pH of from about 5.5 to about 7.5 and that comprises:

from about 0.05 to about 0.3 mol/l of an iron complex of ethylenediaminetetraacetic acid, ethylenediaminedisuccinic acid, or 1,3-propylenediaminetetraacetic acid as a ferric-ligand photographic bleaching agent, from about 0.2 to about 2 mol/l of thiosulfate photographic fixing agent, and from about 0.04 to about 1 mmol/l of one or more of the following compounds (I) through (XIV):

(I)

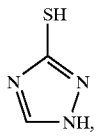

(II)

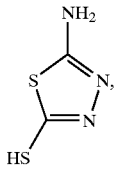

(III)

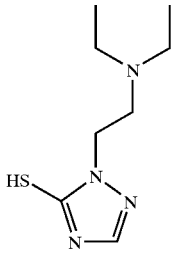

-continued (IV)

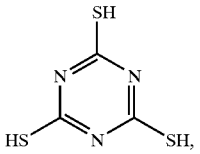

(V)

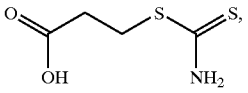

(VI)

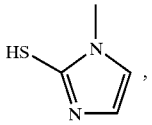

(VII)

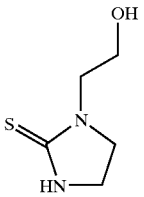

(VIII)

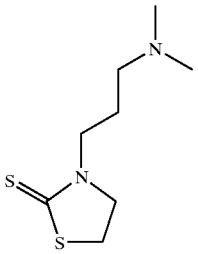

(IX)

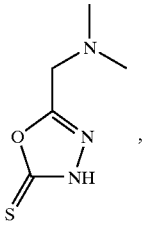

(X)

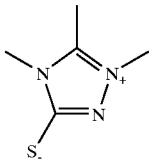

(XI)

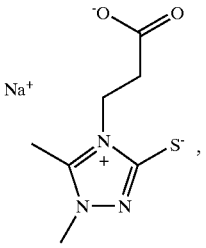

-continued (XII)

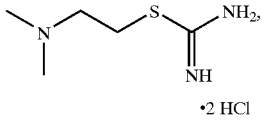

(XIII)

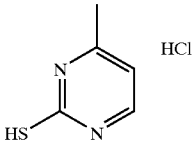

, and (XIV)

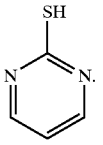

said photographic bleach-fixing composition provided by delivery of a photographic bleach-fixing replenisher to said processing chamber at a rate of 5.4 to about 215 ml/$m^2$, wherein said photographic bleach-fixing replenisher comprises from about 0.05 to about 1.2 mol/l of an iron complex of ethylenediaminetetraacetic acid, ethylenediaminedisuccinic acid, or 1,3-propylenediaminetetraacetic acid as a ferric-ligand photographic bleaching agent, from about 0.2 to about 4 mol/l of thiosulfate photographic fixing agent, and from about 0.04 to about 4 mmol/l of one or more of the compounds (I) through (XIV):

said photographic bleach-fixing replenisher being provided by mixing individual Solutions A and B, wherein Solution A comprises from about 1 to about 5 mol/l of said thiosulfate photographic fixing agent, and Solution B comprises from about 0.5 to about 2 mol/l of said ferric-ligand photographic bleaching agent, and either or both of Solutions A and B comprise from about 0.2 to about 5 mmol/l of said one or more of Compounds (I) through (XIV) noted above, said Solution A being mixed with said Solution B at a volume ratio of from about 1:1 to about 3:1 (A:B), and mixed with water at a volume ratio of from about 1:0 to about 1:10 (A:water), and said bleach-fixing being carried out for from about 18 to about 35 seconds, and C) contacting said photographic color paper with a stabilizing or rinsing solution.

* * * * *